US005789066A

United States Patent [19]

De Mare et al.

[11] Patent Number: 5,789,066

[45] Date of Patent: Aug. 4, 1998

[54] METHOD AND DEVICE FOR MANUFACTURING COLD ROLLED METAL SHEETS OR STRIPS AND METAL SHEETS OR STRIPS OBTAINED

[75] Inventors: Carl De Mare, St. Niklaas; Damien De Soete, St. Martens-Latem; Yves Gadeyne, Assenede, all of Belgium

[73] Assignee: Sidmar N.V., Gent, Belgium

[21] Appl. No.: 596,359

[22] PCT Filed: Sep. 16, 1994

[86] PCT No.: PCT/BE94/00056

§ 371 Date: Apr. 23, 1996

§ 102(e) Date: Apr. 23, 1996

[87] PCT Pub. No.: WO95/07775

PCT Pub. Date: Mar. 23, 1995

Related U.S. Application Data

[63] Continuation-in-part of Ser. No. 424,488, Nov. 1, 1995, abandoned.

[51] Int. Cl.[6] ..... B32B 3/00; B21D 3/02; B32Q 1/00

[52] U.S. Cl. ..... 428/156; 428/141; 428/135; 428/118; 428/212; 428/573; 428/600; 428/612; 428/687; 428/906; 72/119; 72/225; 72/365.2; 29/17.1; 29/17.2; 29/33 R; 29/283.5; 29/895; 29/895.3

[58] Field of Search ..... 428/156, 141, 428/118, 131, 135, 217, 212, 573, 600, 612, 687, 906; 72/199, 225, 252.5, 365.2; 29/17.1, 17.2, 895, 895.3, 33 R, 283.5, DIG. 32

[56] References Cited

U.S. PATENT DOCUMENTS 5,093,180 3/1992 Morgan ..... 428/156

FOREIGN PATENT DOCUMENTS

| | | |
|---|---|---|
| 0 324 327 | 7/1989 | European Pat. Off. . |
| 57-4311 | 1/1982 | Japan . |
| 63-256207 | 10/1988 | Japan . |
| 3-142004 | 6/1991 | Japan . |
| 4-75707 | 3/1992 | Japan . |
| Wo 92/05891 | 4/1992 | WIPO . |

OTHER PUBLICATIONS

Hamilius, et al., *La Revue de Metallurgie*, vol. 89, No. 12, Dec. 1992, Paris, France, pp. 1083–1091.

Dolves, et al., "Electron beam texturing of rolls", *Iron and Steel Engineer*, vol. 68, No. 8, Aug. 1991, Pittsburg, USA, pp. 33–38.

Boppel, *Optik*, vol. 77, No. 2, Sep. 1987, Stuttgart, Germany, pp. 83–92.

Pankert, *Stahl und Eisen*, vol. 110, No. 3, Mar. 14, 1990, Dusseldorf, Germany, pp. 55–60.

*Primary Examiner*—Donald Loney

*Attorney, Agent, or Firm*—Merchant, Gould, Smith, Edell, Welter, & Schmidt, P.A.

[57] ABSTRACT

Method of producing metal sheets or strips by cold reduction rolling of a metal sheet or strip with at least one pair of work rolls, at least one of which being a textured work roll in order to transfer the surface pattern of the textured work roll to the surface of said sheet or strip, characterized in that said pattern of the textured work roll consists in a bidimensional deterministic pattern of spots wherein each spot has the form of a crater with a rim around it.

40 Claims, 15 Drawing Sheets

METHOD AND DEVICE FOR MANUFACTURING COLD ROLLED METAL SHEETS OR STRIPS AND METAL SHEETS OR STRIPS OBTAINED

This application is a Continuation in Part of U.S. application Ser. No. 08/424,488 filed Nov. 1, 1995 now abandoned based on PCT/BE93/00062 designating the U.S.A.

OBJECT OF THE INVENTION

The present invention relates to a method and a device for manufacturing cold rolled metal sheets or strips, through a cold reduction operation in a rolling mill.

The present invention relates also to metal sheets or strips obtained through cold reduction mills preferably by using the method and the device of the present invention.

STATE OF THE ART

The cold rolling process consists essentially in pulling off the strip coming from the hot rolling mill to a cold reduction mill.

The cold reduction mill has the purpose to reduce the total thickness of the metal sheet or strip by an amount usually between 50 and 90%. This operation is performed in several steps and at least in three steps. Such cold reduction can be performed in one stand using a reversible mill or in several stands using a reduction mill called a 'tandem mill' and wherein the several reduction steps are performed in one sequence.

The cold rolled sheet or strip is then heated up in a furnace, this process is known as annealing process. Afterwards, the annealed sheet or strip passes through a second cold roll mill called 'skin pass' or 'temper mill' in order to undergo a small cold deformation for improving mechanical properties and surface qualities of the metal sheet or strip.

During a cold reduction operation, the pressure applied to the rolls is higher than 10 kN/mm and the tension between two reduction steps is about 200 Pa, while during a temper rolling operation the normal pressure is less than 5 kN/mm and the tension between two reduction steps is about 25 MPa.

The physical properties of the metal sheet after a rolling operation in a reduction mill are completely different compared to the properties of the material after a skin pass or temper rolling operation.

Summarized hereunder are the main properties of the metal sheets or strips:

| | Reduction operation | Skin pass operation |
|---|---|---|
| Rockwell B hardness (Euronorm A11-106 and A11-108) | min 80 (full hard) | 30 to 60 |
| Bend test (Euronorm 117-02) | no bending in either direction | bend flat on itself in any direction |
| Yield strength (Euronorm EN10002-1) | 550 to 750 MPa | 130 to 240 MPa |
| Elongation in 50 mm (Euronorm EN10002-1 or ASTME8M) | <10% | 30 to 50% |

It is a common practice in cold rolling devices to apply a certain roughness to the work rolls, preferably for the last step of the rolling operation in a cold reduction mill or for the only stand of a temper mill.

In the case of a cold reduction reversible mill, the mill work rolls are changed before the last step of the reduction operation for textured work rolls, and in the case of a tandem mill, only the last stand comprises textured work rolls.

To give such roughness to work rolls, several texturing technologies are known and are summarized in "Stahl und Eisen, Vol. 110 (1990), 14 March, No. 3, Dusseldorf, Del.".

1°) Shot Blast Texturing (SBT)

Iron particles (grit) with a specific granulometry are sprayed on the surface of a work roll. The kinetic energy of the particles is sufficient to deform the surface plastically. The work roll roughness is function of the grit (angularity, mass, size), the velocity of rotation of the work roll, the hardness of the roll material, the number of passes along the roll and the rotating speed of the roll.

With SBT technology, roughness values (Ra) on the work roll comprised between 1.5 μm and 6.0 μm can be obtained.

The roughness profile shows a random distribution of peaks and valleys. No regular pattern can be distinguished.

Although SBT has a high productivity, this technology has major drawbacks:

It is difficult to reproduce the work roll roughness.

Therefore the Ra value obtained on the roll after texturing shows a large scatter band.

Very high roughness values (Ra>5 μm) can only be obtained with relatively softer rolls (hardness lower than 90 Shore C). Such rolls have only a shortlive service time.

The sharp edges of the roughness break off rapidly so that the wear of the work rolls during a rolling campaign is always important.

The roughness parameters can not be chosen independently from each other. So there is a relationship between the roughness value (Ra) and the number of peaks/cm value (Pc) measured on the sheet.

Until now most of textured rolls for a cold reduction mill are textured with this technique.

2°) Electrical Discharge texturing (EDT)

An anode, separated from a copper electrode (cathode) by a dielectric medium, causes an electric discharge which is able to produce craters or indentations on the roll surface.

Actually, several cathodes are coupled to each anode and since the cathodes spark independently from one another, the crater morphology due to the spark from a single electrode is rapidly destroyed due to the overlap of the multiple discharges from adjacent electrodes. This leads to a surface roughness which is substantially random. The randomness is more pronounced as the number of passes is increased.

The roll roughness is a function of the voltage frequency (higher frequency leads to higher peak counts), the voltage applied to the electrodes (positive voltage results in rougher surface than negative voltage) and the level of capacitance in the electronics.

Compared to the Shot Blast system, EDT is not significantly dependent upon the hardness of the work roll. The low roughness texture produces a higher number of peaks/cm and the reproducibility is better.

The EDT system has also some important drawbacks:

to produce high roll roughness, a high current density is necessary. This causes extensive heating of the roll material with can result in structural changes of the roll material.

to produce low roll roughness a high number of passes of the electrode manifolds are necessary to destroy the initial craters. Therefore the texturing time increases as the Ra decreases.

a roughness with sharp cutting edges is produced which can micro machine the sheet surface leading to unwanted wear debris generation.

the roughness value (Ra) and the number of peaks per cm value (PC) can not be chosen independently of each other. There is an exponential relationship between Ra and PC for EDT as for SBT. However the PC value is 30 to 50% higher for EDT compared to SBT.

an initial waviness of the roll surface can occur. As the gap between roll and electrode is larger in the waviness troughs, the sparking is imperfect in the troughs and adequate on the crests in the waviness profile. As the texture depends upon the initial height of the surface, the initial waviness leads also to Moiré fringes on the roll.

This texturing technique is not frequently used for texturing rolls for a cold reduction mill due to the important wear of the roll in such case.

3°) Laser Texturing (LT)

A laser beam hits the roll surface in order to melt the roll material and to blow the material out of the crater with an assisting gas ($O_2$, $CO_2$ or Ar). The final roll texture corresponds with a uniform distribution of craters along a helical path on the work roll circumference. The axial crater distance is controlled by the speed of the longitudinal movement of the roll. In the tangential direction, the crater distance is determined both by the speed of the roll and the speed of the mechanical chopper. The crater depth is determined by the laser power. The shape of the crater tends to become more and more elliptical as the shot time is increased due to the fact that the laser beam is not deflected during the shot so that the beam spot on the roll is moving.

The laser technology introduced the so-called deterministic roughness in one direction. However, it has itself important drawbacks:

due to the mechanical chopper of the beam which put severe constraints on the texturing capabilities, only a limited variation in textures is possible.

the crater rim is composed of partly oxidised material and the brittleness of the rim causes it to break during rolling, giving rise to a rapid decrease in roll roughness the texture is only deterministic in the direction of the helical path and at present is not possible to obtain a fully deterministic pattern (due to the position of each crater with the mechanical chopper).

There is an irregularity of the rim due to the use of a lateral gas and to the fact that pre- and post-heatings of the roll surface are not possible.

It should be noted that the laser technology is practically not used for texturing rolls for a cold reduction mill because of the important wear of the work roll (oxydation of the rim) and because of a moiré problem which especially occur in the case of a cold reduction mill.

4°) Electron Beam Texturing (EBT)

The application of a special electron beam technology for texturing rolls was initially developed for the engraving of rotogravure printing cylinders by Linotype Hell (see WO-A-9205891, WO-A-9205911, WO-A-9210327).

This method consists in bombarding an electron beam on a surface roll. During a single shot, lenses focus the beam to preheat the roll material, then to bombard the surface with a first shot in order to create a crater and to post heat the rim surrounding the crater. This cycle can be done two or three times on the same spot to create deeper craters. During the shot cycle, the beam is deflected to compensate the continuous movement of the roll surface (shift and rotation). In this way perfectly round crater rims are obtained.

The very fast electronic pulsation of the beam controls the position of each crater in order to create a two dimensional pattern. Some examples of patterns are shown in document "La Revue de Métallurgie—CIT—Décembre 1992 dans "Gravure des Cylindres" par A. Hamilius et al.".

The lenses permit also an accurate control of the diameter of the beam and of the shot time. These two parameters are directly linked to the diameter and the depth of the crater on the surface roll. By changing the diameter on crater distance, deterministic (comprising semi random or pseudo random) textures are obtained.

This technology is only used until now for texturing work rolls for 'skin pass' or 'temper devices' using one EBT pilot plant. The two main advantages mentioned in this document "La Revue de Métallurgie—CIT" are the paint appearance on the metal sheet obtained after temper rolling as well as its drawability being improved.

AIM OF THE INVENTION

The main aim of the present invention is to propose an improved method and an improved device for manufacturing metal sheets or strips having better properties.

MAIN CHARACTERISTICS OF THE PRESENT INVENTION

The present invention relates to a method of producing metal sheets or strips by cold reduction rolling such sheets or strips, with at least one pair of work rolls, at least one of which being a textured work roll in order to transfer the surface pattern of the textured work roll to the surface of said sheet or strip, characterized in that said pattern of the textured work roll consists in a bidimensional deterministic pattern of spots wherein each spot has the form of a crater with a rim around it. Preferably, said spots are obtained through a high energy beam such as an electron beam.

The roughness of the textured work roll in the cold reduction mill is comprised between 0.4 and 8.0 μm and preferably between 1.0 and 3.5 μm, although the sheet roughness performed with the process according to the present invention is in the range of 0.3–2.5 μm and preferably in the range of 0.5–2.0 μm.

More particularly, the ratio of the width to the height of the rim is at least 2 and preferably at least 3 and the ratio crater diameter to of crater depth is larger than 4.

The distance between two adjacent craters is between 50 and 550 μm and preferably between 130 and 320 μm with a depth between 5 and 50 μm and preferably between 8 and 30 μm.

The inside diameter of the crater is between 20 and 250 μm and preferably between 50 and 180 μm although the width of the rim is in the range of 4–100 μm and preferably in the range of 10–75 μm, and the height of the rim is in the range of 2–50 μm and preferably in the range of 5–35 μm.

According to a preferred embodiment of the method of the present invention, the metal sheet or strip, after the cold reduction rolling operation as mentioned hereabove, is temper rolling with at least one pair of work rolls, at least one of which being a textured work roll in order to transfer the surface pattern of the textured work roll to the surface of said sheet or strip, said pattern of the textured work roll in the temper mill having a bidimensional deterministic pattern of spots wherein each spot has the form of a crater with a rim around it. Preferably, said spots are obtained through a high energy beam such as an electron beam.

The roughness of the textured work roll in the temper mill is between 0.4 and 8.0 μm and preferably between 1.6 and 6.0 μm although the sheet roughness performed with this last embodiment of the present invention is in the range of 0.5–6.0 μm and preferably in the range of 0.8–4.0 μm.

Preferably, the metal sheet or strip which was textured on one side in the cold reduction mill should be textured on the same side by a textured work roll in the temper mill.

If the metal sheet or strip is not reversed between the cold reduction and the temper rolling phases, this means that the upper and/or lower work roll of the pair of work rolls in the temper mill should correspond to the textured upper and/or lower work roll of the pair of work rolls in the cold reduction mill.

According to another preferred embodiment of the method of the present invention, both rolls of the pair of work rolls in the cold reduction mill and/or in the temper mill have a texture of surface pattern which has a bidimensional deterministic pattern of spots.

Preferably, the cold reduction or temper mill textured rolls are engraved with the "EBT process" by an electron beam under vacuum. By this technique, over a few square microns, an electron beam brings the roll surface to melting temperature and, under plasma pressure, the molten metal is ejected and forms around the crater a controllable and defined rim integrated within the base metal. The shape and the size of the rim are controlled by pre- and post-heating periods of the electron beam irradiation.

The texture of the work roll is reproduced on metal sheets or strips during the rolling process in the cold reduction mill or in the temper mill.

Preferably, the pattern configuration forms unit cells such as regular centred hexagons.

The present invention relates also to a device for producing metal sheets or strips comprising at least a cold reduction roll mill with at least one pair of work rolls characterized in that at least one roll of the pair of work rolls has a texture of surface pattern which has a bidimensional deterministic pattern of spots wherein each spot has the form of a crater with a rim around it.

According to a preferred embodiment, the cold reduction rolling mill is a reversible mill comprising only one stand of work rolls performing several steps of a reduction operation. In such a case, the work rolls are changed before the last step of the rolling operation in textured work rolls having a texture of surface pattern which has a bidimensional deterministic pattern of spots.

According to another preferred embodiment of the invention, the cold reduction rolling mill is a tandem mill comprising several stands and wherein only the last stand comprises at least one textured work roll having a texture of surface pattern which has a bidimensional deterministic pattern of spots. The reduction operation is performed in one sequence.

According to another preferred embodiment of the present invention, the device comprises also a temper roll mill with at least one pair of work rolls wherein at least one roll of the pair of the work rolls in the temper mill has a texture of surface pattern which has a bidimensional deterministic pattern of spots wherein each spot has a form of a crater with a rim around it.

According to another preferred embodiment of the device of the present invention, both work rolls of the pair of work rolls in the cold reduction mill and/or in the temper mill have a texture of surface pattern which is a bidimensional deterministic pattern of spots.

The present invention also relates to a metal sheet or strip having a texture of surface pattern which has a bidimensional deterministic pattern of spots, each spot having the form of an indentation surrounding a protuberance or peak, and wherein high wavelengths (waviness) are practically absent from the power spectrum.

This means that for a power spectrum measured on a profile of 40 mm, the main power density for wavelengths larger than 800 μm is less than 0.2 $\mu m^2$ and preferably less than 0.1 $\mu m^2$.

Preferably, the metal sheet or strip showns an elongation (in 50 mm) less than 10% (Euronorm EN10002-1).

In the case that the metal or strip is of steel, the hardness of the sheet or strip is higher than 80 (Rockwell).

As already mentioned, the roughness of the metal sheet or strip is comprised between 0.3 and 2.5 μm and preferably between 0.5 and 2.0 μm.

More particularly, the ratio of the width to the depth of the indentation on the sheet or strip is at least 2 and preferably at least 3 and the ratio protuberance diameter on protuberance height is larger than 3 and preferably larger than 4.

The distance between two next protuberances or peaks is between 50 μm and 550 μm and preferably between 130 and 320 μm with a height of the protuberance between 0 μm and 30 μm.

The inside diameter of the indentation is between 20 μm and 250 μm and preferably between 50 μm and 180 μm although the width of the indentation is in the range of 4–100 μm and preferably in the range of 10–75 μm and the depth of the indentation is in the range of 0–50 μm and preferably in the range of 5–30 μm.

According to a first embodiment, the surface texture of the metal sheet or strip shows imprints (indentation) of the rim present on the textured roll. In this case, the presence of protuberances or peaks for which a material of the sheet or strip has been extruded into the crater of the textured roll can (height of the protuberance not equal to 0) or cannot (height of the protuberance close to 0) occur depending on the thickness reduction.

According to another embodiment, the surface texture of the metal sheet or strip shows only protuberances or peaks almost without any imprints (indentation) of the rim present on the textured roll. In this case, the depth of indentation is close to 0 μm and has a very large width.

Preferably, the pattern configuration forms unit cells such as a regular centred hexagons.

The above-mentioned characteristics are related to a metal sheet or strip which is an intermediate product and which has not yet been subjected to an annealing process and to a subsequent temper rolling operation.

The present invention also relates to a final product which has been rolled in the cold reduction mill with EBT rolls, and has been subjected to an annealing process and possibly to a subsequent temper rolling operation.

If the metal sheet or strip as described hereabove has been subjected to an annealing process without any temper rolling operation, it will not have any internal tension at the surface.

This last property can be checked using one of the following techniques: x-ray diffactometry, ultrasonic measurement, measure of the microdeformation during an etching of the surface layer, microhardness.

If the temper rolling is performed with a SBT or EDT textured roll, a stochastic roughness partially covers the bidimensional deterministic pattern of spots on the metal sheet or strip.

If the temper rolling operation has been performed with a laser textured roll, a uni-deterministic roughness partially covers the bidimensional deterministic pattern of spots on the metal sheet.

If the temper rolling operation has been performed with an EBT textured roll, the metal sheet or strip has a final texture of two populations of texture surface pattern each of which has a bidimensional deterministic pattern of spots.

Such metal sheets or strips can be made of steel, stainless steel , aluminum or aluminum alloys.

Such metal sheets or strips can also be coated with metallic or organic layer such as painting, galvanizing, aluminization.

PROBLEMS TO BE SOLVED BY THE PRESENT INVENTION

The roughness of the work rolls used in the last step of a rolling operation in a cold reduction mill causes three major consequences:

1°) Avoiding cold welding (sticking) of the coil spires during the batch annealing. During the batch annealing, the outer spires of the coil are heated faster than the inner. The temperature gradient causes thermal pressure between the spires. The pressure becomes so large that the spires weld together. Such a welding is called a "sticking". During decoiling before temper rolling, stickers break but leave a mark on the sheet surface. This defect is called "sticker marks". The surface roughness reduces the tendency to form stickers during batch annealing.

2°) Ascertaining adhesion of a coating on a steel substrate (hot dip galvanizing and galvannealing). In a hot dip galvanizing line, the full hard material (steel sheet obtained after tandem rolling) is first annealed in a continuous annealing line and then dipped in a Zinc bath at 470° C. The roughness of the sheet is important to pick up the Zinc. Minimal roughness values comprised between 0.8 μm and 1.2 μm are required depending on the specification of the Zn thickness.

3°) Giving rise to a final roughness after temper rolling, which is a mixture between the reduction mill roughness and the subsequent temper mill roughness. For certain applications, as bathtubs, extreme high roughness of metal sheets are necessary (Ra>3.5 μm). Such high values can not be obtained only by temper rolling. Therefore a high surface roughness after a cold reduction rolling is also required.

Furthermore, the high hardness of metal sheets or strips in the case of steel or stainless steel sheets or strips obtained by a rolling operation in a cold reduction mill and the thickness reduction of 5 to 10% during the last step of the rolling operation cause specific problems which are unknown in the case of the temper rolling mill.

Figure 1:
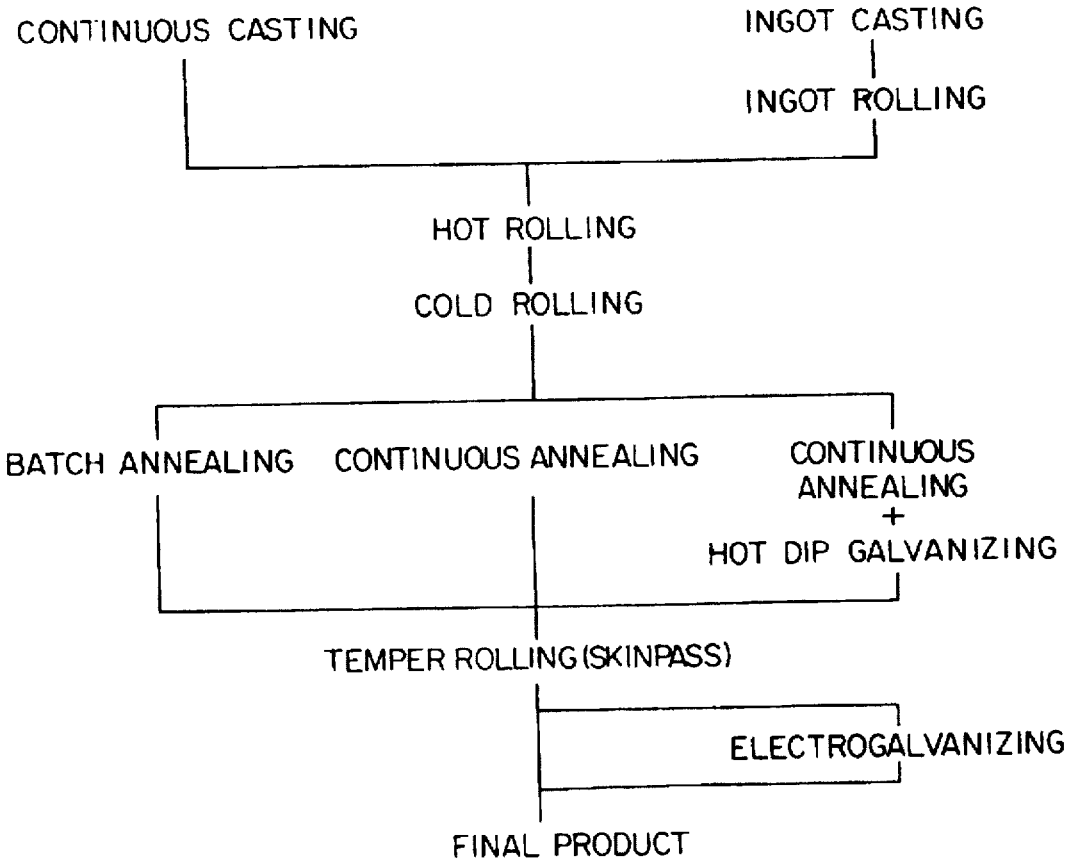
FIG. 1 represents a steel sheet production flow diagram.
Figure 2:
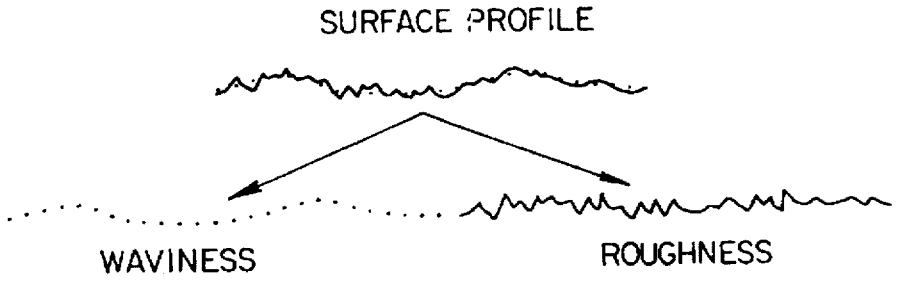
FIG. 2 represents a schematic view of the decomposition of the surface profile for a metal sheet in roughness and waviness.

Using random texturing methods such as SBT or EDT for texturing work rolls, the presence of long wavelength undulations, the so-called "waviness", is observed (see FIG. 2).

The waviness produced during said texturing methods is due to:

random variation in roll hardness, variation of the energies of the shot blast particles in the case of a SBT technology;

variation in the electric energy of the eroding spark, variation in the electric conductivity of the roll material in the case of an EDT technology.

For a same roughness value, the waviness of SBT or EDT textured rolls are not significantly different. Tests with different grinding procedures showed that the waviness of the strip after cold rolling cannot be reduced by lowering the roughness of the ground roll prior to EDT.

Figure 3:
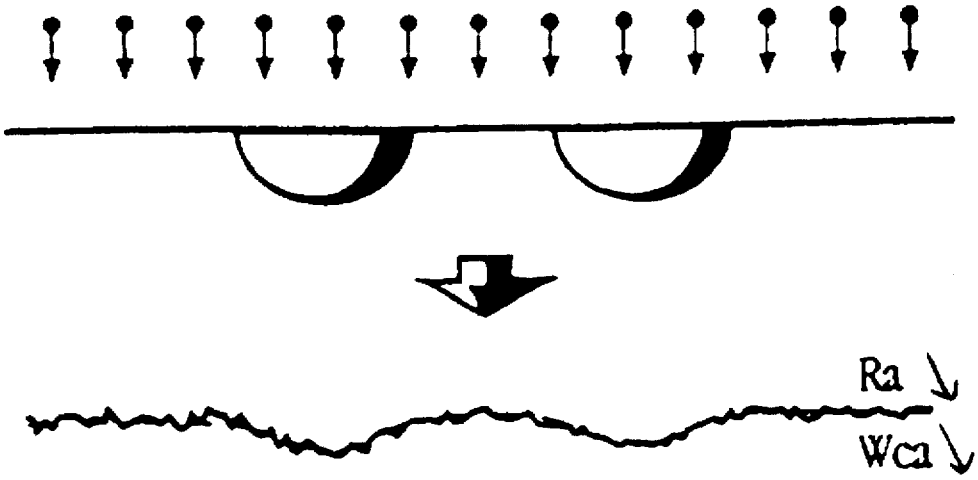
FIGS. 3 & 4 represent the relationship between roughness and waviness for random texturing processes (SBT) in the case of a low roughness (FIG. 3) and in the case of a high roughness (FIG. 4).
Figure 4:
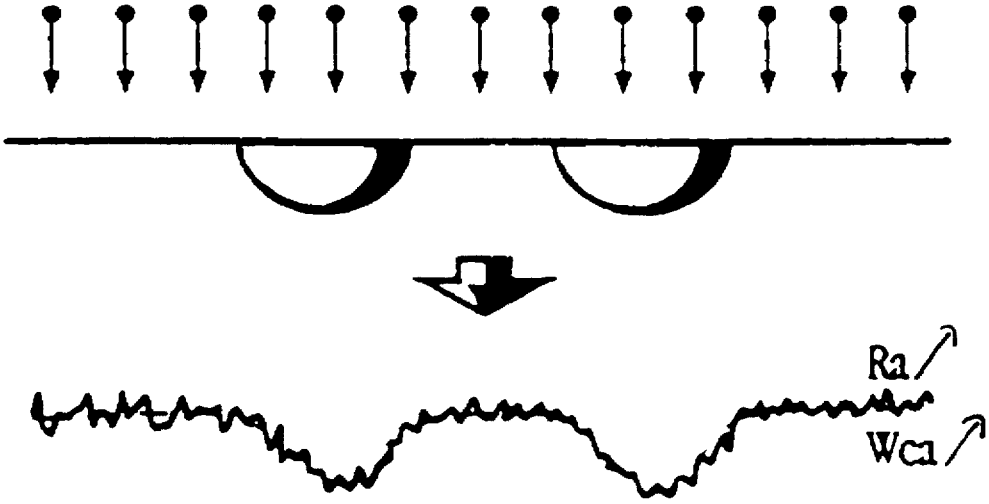

Computer simulations of the SBT process show that any attempt to increase the roughness of the roll will increase the waviness (see FIGS. 3 and 4).

Figure 5:
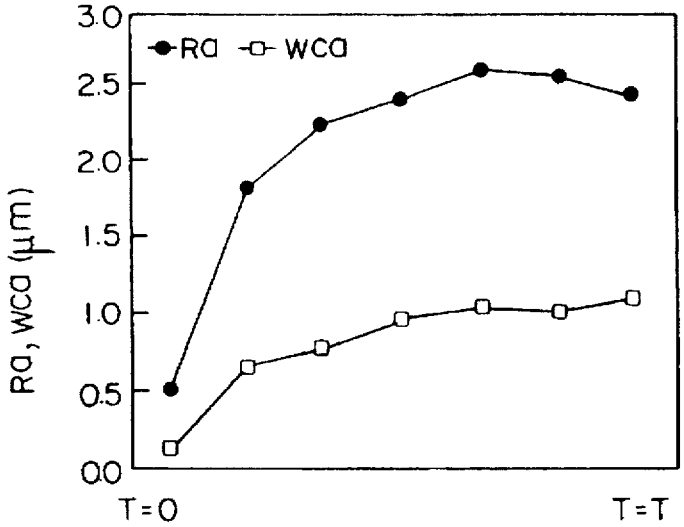
FIG. 5 represents the evolution of the roughness and the waviness during an EDT of a roll.

A same relationship between the roughness (Ra) and the waviness (Wa) values is found on the EDT rolls. FIG. 5 shows the Ra and Wa values for the EDT roll as a function of the texturing time or the degree of texturing. As the degree of texturing increases, both Ra and Wa increase.

These results indicate that waviness is introduced during texturing as a direct consequence of efforts to make the roll rougher. The inherent variability of the SBT and EDT methods is responsible for the random nature of the resulting texture, and also for introducing a wide range of topographic wavelengths on the roll surface.

The waviness of the roll surface is transferred to the sheet roughness easier during the cold reduction operation than during temper rolling. The higher pressures (due to harder sheet and larger thickness reduction) and the longer contact between sheet and roll (due to larger thickness reduction) make that even the long wavelength undulations in the roll are imprinted on the sheet surface.

Figure 6:
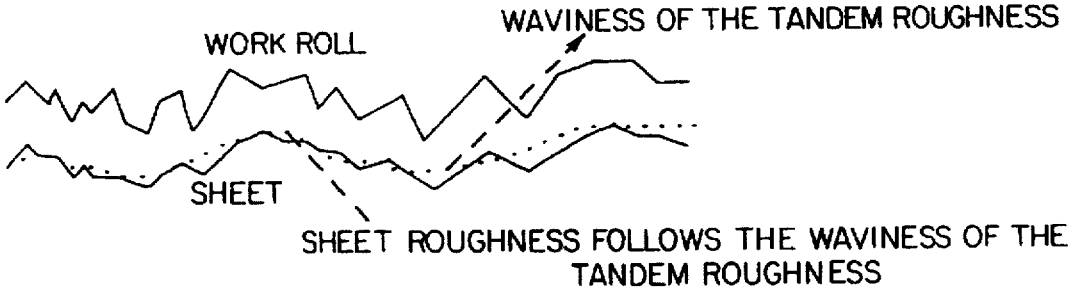
FIGS. 6 & 7 represent the transfer of waviness during the cold reduction rolling (FIG. 6) and the additional roughness transfer in the temper mill (FIG. 7).
Figure 7:
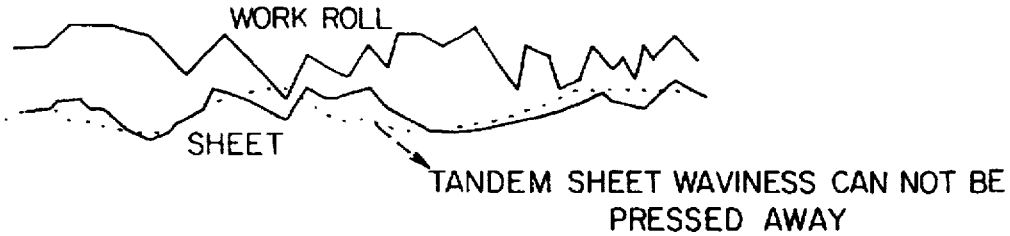

However, to avoid sticker marks after batch annealing, the Ra-value of the cold reduction mill roughness needs to be high. Therefore, shot blast or EDT rolls with high Ra-value (5 to 6 μm) and unfortunately high Wa, are used. This results in a high waviness after cold rolling. As the thickness reduction in the temper mill is small (0.5 to 1.0%), the cold reduction waviness cannot be ironed out and remains present in the final roughness (see FIGS. 6 and 7).

Figure 8:
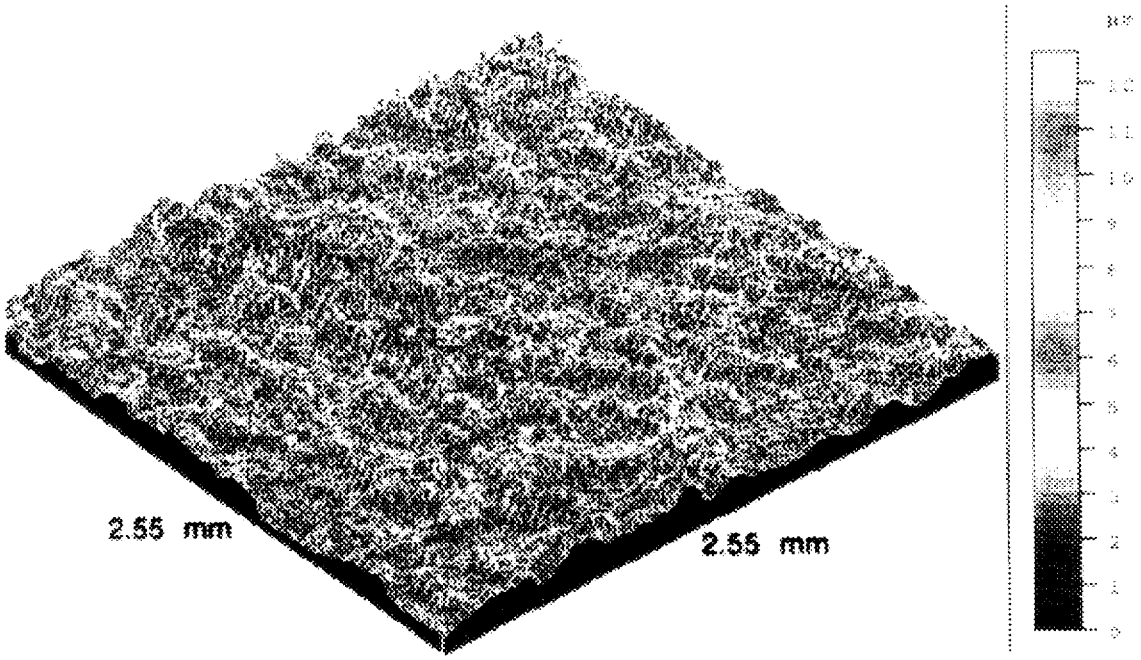
FIGS. 8 & 9 represent the sheet surface after cold reduction rolling with SBT rolls, followed by temper rolling with EBT rolls.
Figure 9:
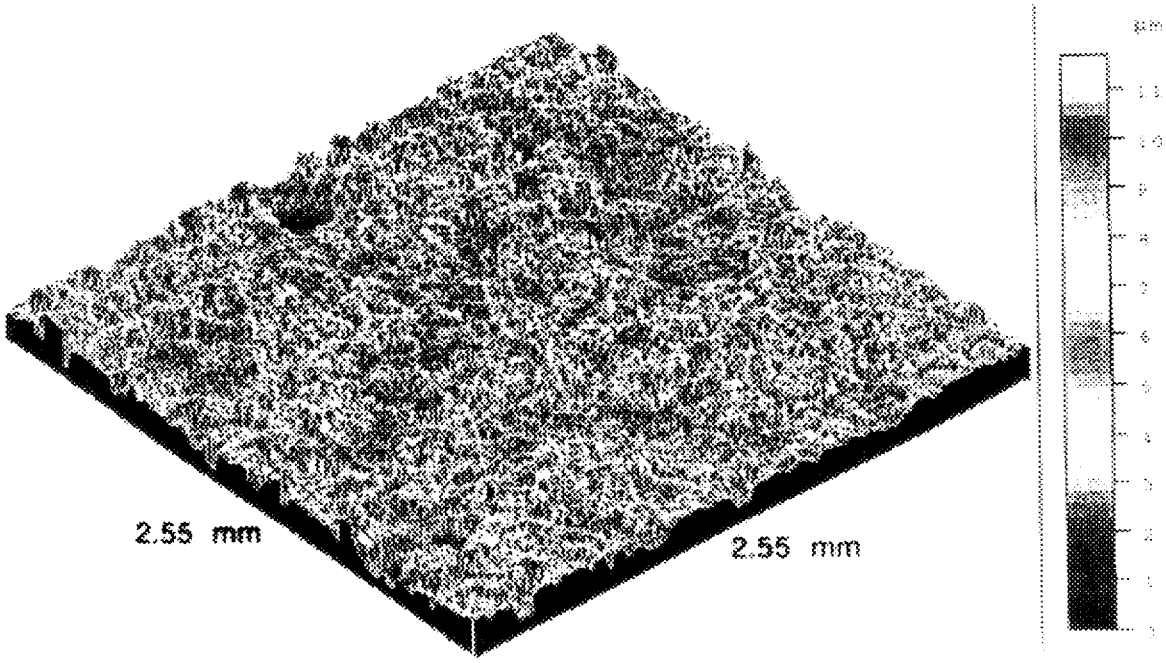

Even if during temper rolling EBT or LT textured rolls are used, the final surface contains the waviness of the cold reduction rolls (see FIGS. 8 and 9).

Figure 10:
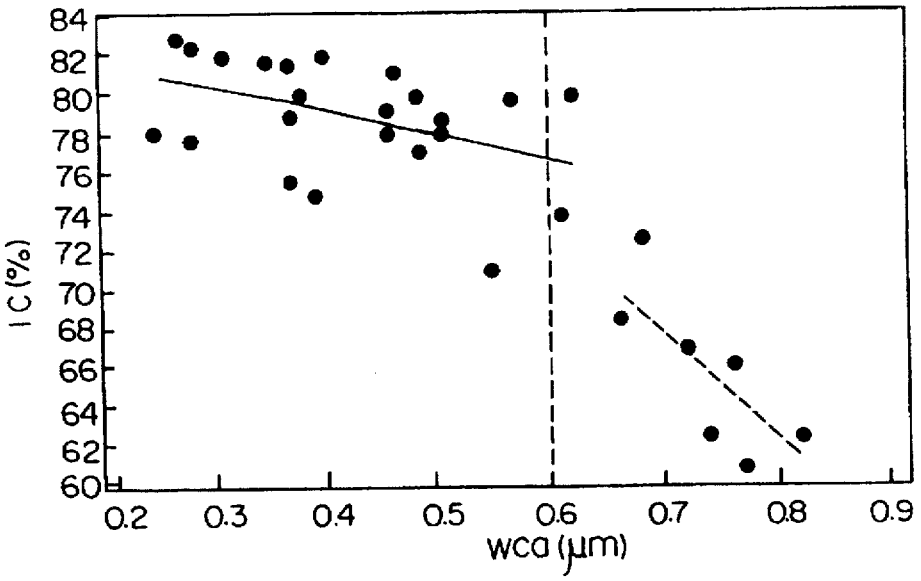
FIG. 10 represents the relationship between the waviness of a metal sheet and the image clarity after painting.
Figure 11:
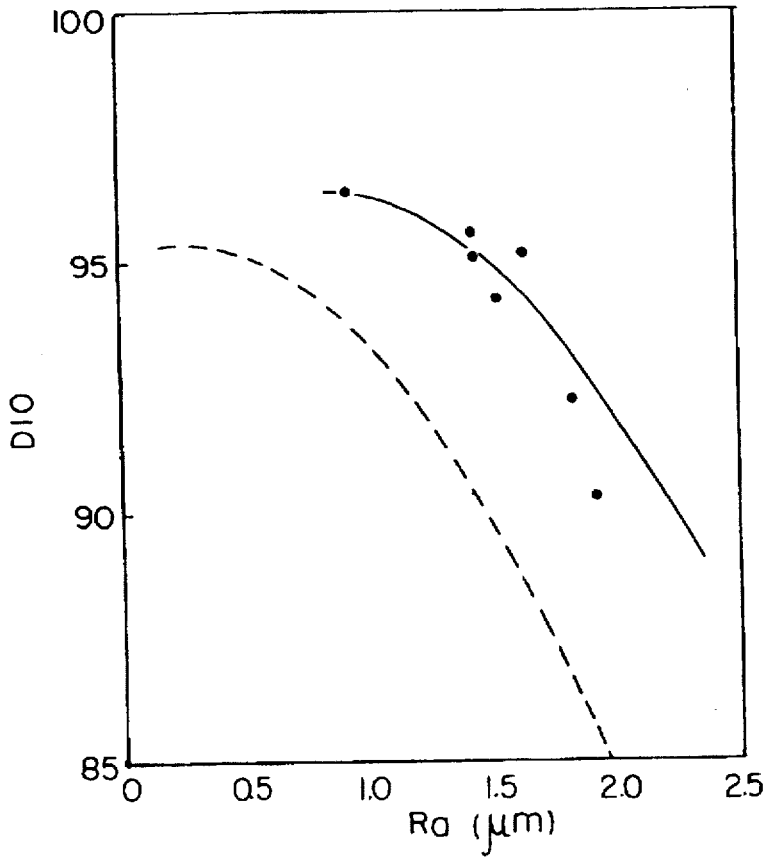
FIG. 11 represents the influence of the sheet when the temper mill method is LT or SBT on the paint image clarity.

The waviness is detrimental for the appearance of painted parts, as shown in FIGS. 10 and 11.

Another problem of the present invention is the important wear of the textured rolls used in the cold reduction mill and obtained by the conventional methods. The wear is due to the high shearing forces during cold reduction rolling, which results in the large thickness reduction of the sheet or strip and a high hardness of the material in the case of steel sheet. This is definitely the case for EDT rolls, due to the fine and sharp edges.

Another problem of the present invention is to reduce the pick up of iron fine, especially when low roughness SBT and EDT rolls is produced. The iron fines, present in the emulsion of the cold reduction mill, will stick on to the work roll when the peaks of the roll roughness are sharp. The work roll and backup roll are then damaged and the rolling process must be stopped.

For this reason, the present tendency is to try to produce a lower tandem roughness without jeopardizing the batch annealing and the coating adhesion. With classical roughing techniques, this effort is however limited due to the irregular character (waviness) of the applied roughness.

DETAILED DESCRIPTION OF THE PRESENT INVENTION

Figure 12:
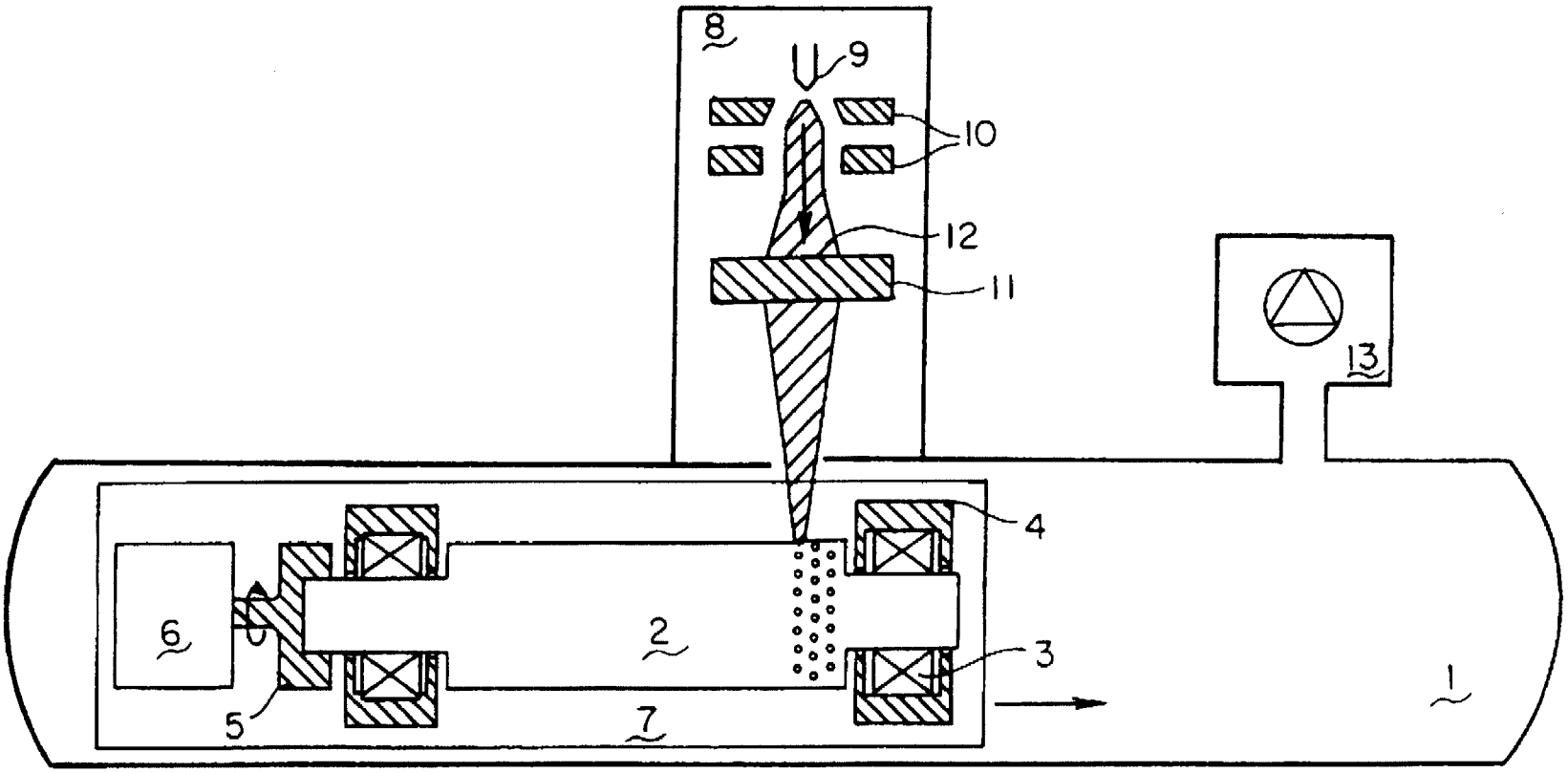
FIG. 12 is a schematic view of the EBT machine which is intended to texture cold rolls used in the method and the device of the present invention.

FIG. 12 describes an EBT machine which is intended to produce specific textures on cold rolls to be used in the method and the device of the present invention.

In general, one can compare the EBT machine to a highly energetic TV set, wherein the screen has been replaced by the roll surface to be textured. From this, the main advantages are:

flexibility
reproducibility
predictability
productivity
reliability
full automation.

The EBT machine is essentially composed of the following parts:

the texturing chamber (1);
the electron gun (8);
the vacuum pump (13);
the closed circuit heat exchanger (not represented)
the electrical control cabinets (not represented).

The texturing chamber (1) includes a cast steel base and aluminum cover, giving rise to an airtight unit. The cover has a movable lid on the top, in order to enable the loading and unloading of the rolls (2). During texturing the vacuum in the chamber (1) is kept constant at $10^{-1}$ mbar. The roll is rotated by means (3, 4, 5) of a continuously variable speed drive motor (6) between 0 and 1000 rpm, whereas a shifting mechanism (7) takes care of the translation of the roll (2) in front of the fixed position of the electron gun (8). From the moment a texture is chosen and the roll (2) is introduced into the texturing chamber (1), the machine set-up and the texturing process is performed automatically. The EBT machine is controlled by means of five microprocessors which are linked to each other and to the central control PC via a LAN (Local Area Networks) system, which is executed with fiber optics in order to avoid unwanted noise.

The principal part of the EBT machine is the electron gun (8) which is rigidly attached to the backside of the texturing chamber (1). As represented in FIG. 12, the electron beam gun (8) is composed of three parts:

the accelerator unit (10) with the cathode (9)
the zoom lens unit (11)
the focusing unit (11)

Figure 13:
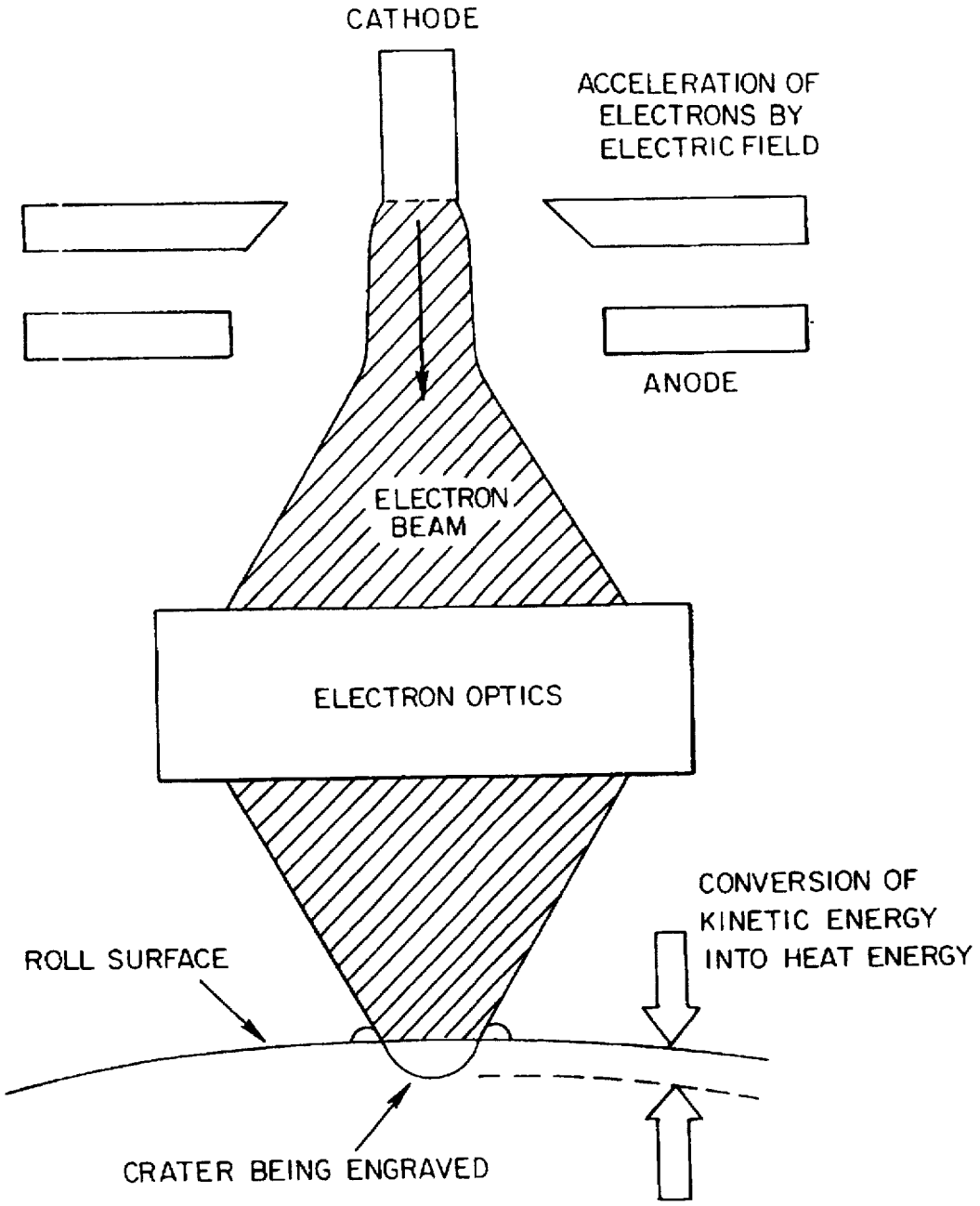
FIG. 13 is a schematic view of the electron beam gun of the machine of FIG. 12.

The electron gun can be described as a classical triode, equipped however with fast pulsing and zoom lens optics, which make it unique. The crater and rim forming process is schematically represented in FIG. 13. The gun operates under a vacuum of $10^{-3}$ to $10^{-4}$ mbar and uses an accelerating voltage of 200 kV at a maximum current of 75 mA. A direct heated cathode produces the electrons. The pulse frequency of the gun is continuously variable, with a maximum of 200 kHz. The shot cycles for the formation of a single crater, which can be performed in single or double shot, is represented as follows:

- double shot
  - single shot
    - preheating — - avoids metal sputtering; - welds the rim to the base metal
    - first shot postheating
  - preheating second shot postheating — - controls width and height of the crater rim The total shot cycle time per crater (first and possible second shot) is in the range of 2 to 15 μsec.

The electron beam is deflected in order to follow the translation and rotation of the roll during a crater formation. In this way, the whole roll surface is textured with circular craters. The shift speed is continuously variable from 0.03 to 0.36 m/min. The shift speed is controlled by the shift and rotation speed of the roll, monitored by decoders, which in turn control the timing of the impact of the electron beam.

The roll texture is formed by a two-dimensional deterministic pattern of craters, generated by a high energy beam (i.e. an electron beam), each crater being surrounded by a crater rim.

The two-dimensional pattern has a constant structure and is defined by three parameters : dL, dA and n.

dL is the distance between two craters measured in the circumferencial direction of the roll dA is the distance between two circumferences in the axial direction n is the number of windings on the roll before the crater has the same circumferencial position on the roll, n can be an integer or a real number (that is not equal to a fraction of two integers)

Figure 14:
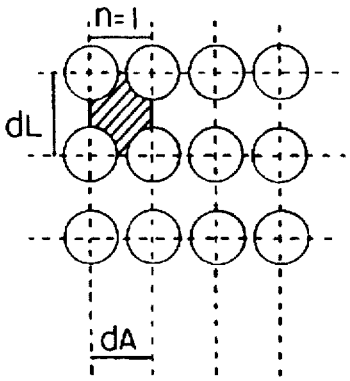
FIGS. 14,15 & 16 represent a schematic view for three examples of deterministic EBT texture (two dimensional crater patterns).
Figure 15:
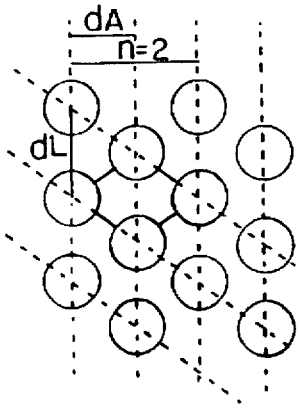
Figure 16:
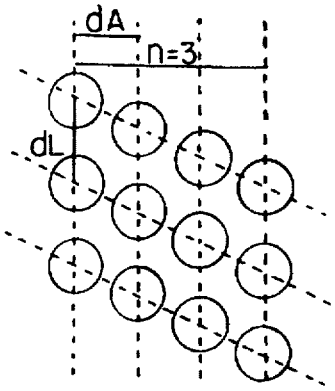

Some examples of unit cells are given in FIGS. 14, 15 and 16.

The pattern of FIG. 14 has a rectangular unit cell: the craters have the same position in each winding of the helix.

The pattern of FIG. 15 has a hexagonal unit cell: after two windings of the helix the crater is placed in the same position in the axial.

In the pattern of FIG. 16, after three windings the crater has the same circumferencial position.

The distances dL and dA can be chosen in a wide range: between 80 and 550 μm. The number n is an integer larger or equal to 1 (no limitation to the maximum) . For every prime number or a real number, a different pattern is found. When n is a fraction or an integer larger than the number of windings on the roll (typically about 20000), there is almost no periodicity in the pattern in the axial direction. This method permits the creation of a pseudo random ordering of the craters in the axial direction.

Figure 17:
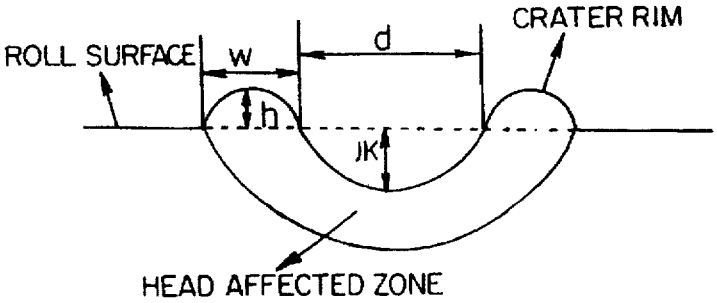
FIG. 17 represents a schematic view of an example for a circular crater shape obtained by EBT.

The shape of the crater is a function of the beam diameter d, the shot time ts and the deflection of the beam during the shot. When the beam follows the roll surface during the shot, circular craters can be created with a crater depth K proportional to the shot time ts (see FIG. 17).

When there is no deflection or a negative deflection (deflection is opposite direction of the roll surface), then more or less elliptical craters are obtained.

The shape of the crater rim is affected by the pre- and post heating, by the energy distribution over the beam radius, the position and the relation between crater diameter and the crater pattern. A round circular rim with smooth edges is generated when the crater diameter is small compared to the distance between two craters and when the post heating is long.

By increasing the preheating and decreasing the post heating a more and more irregular rim can be formed.

A discontinuous rim, composed of several heaps of roll material, can be found when the crater diameter is approximately 80% of the distance between two craters. The shape of the heaps and the number of heaps per crater is function of the parameters dL, dA and n.

Figure 18:
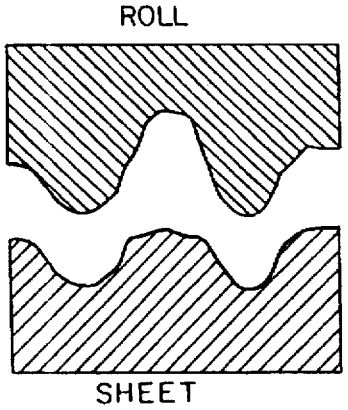
FIGS. 18 & 19 represent a view wherein a metal sheet has been obtained after tandem rolling and after temper rolling.

The transfer of the roughness from the textured work roll to the sheet is totally different in the cold reduction mill compared to the temper mill. In the temper mill, the sheet roughness is created by the imprint of the rim in the sheet (see FIG. 18).

Figure 19:
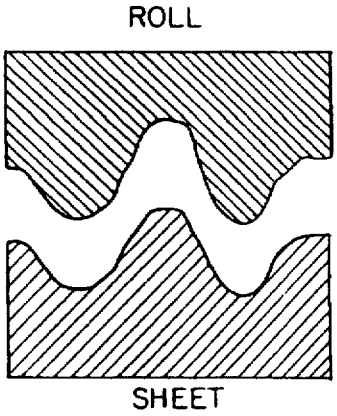

In the cold reduction mill, the surface of the sheet contains not only the imprints of the rim but also peaks or protuberance where the material has been extruded into the crater depth, due to the high shearing forces. So the crater depth influences directly the roughness after the cold reduction step (see FIG. 19).

Figure 20:
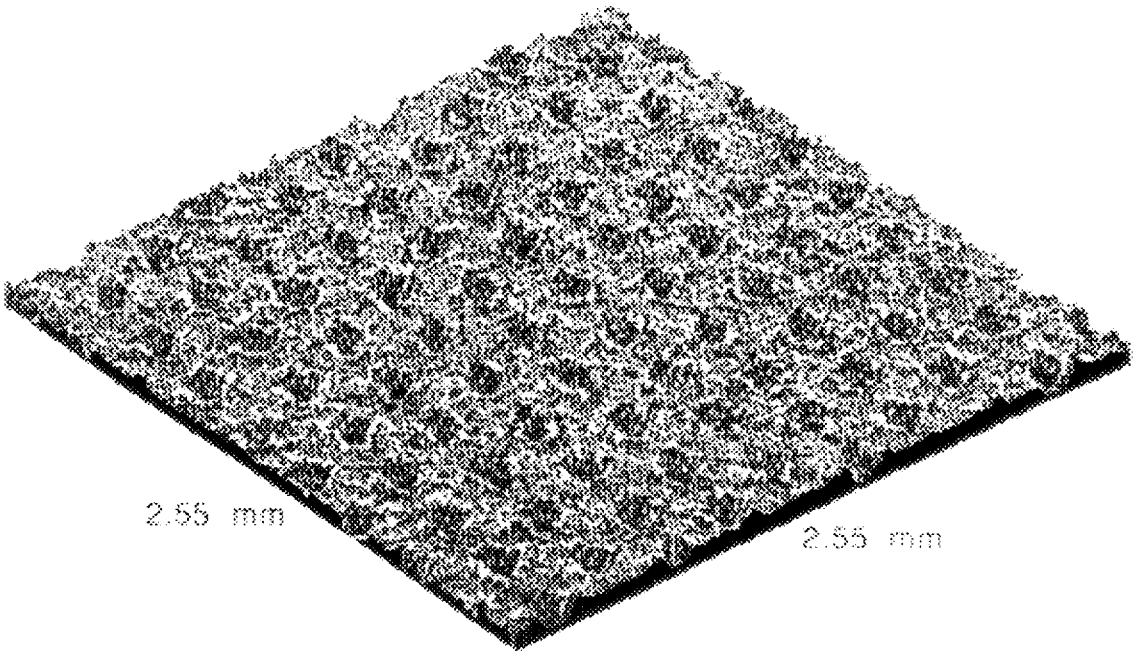
FIGS. 20 & 21 represent three dimensional measurements of a textured work roll in a tandem mill and a tandem mill rolled strip according to the present invention.
Figure 21:
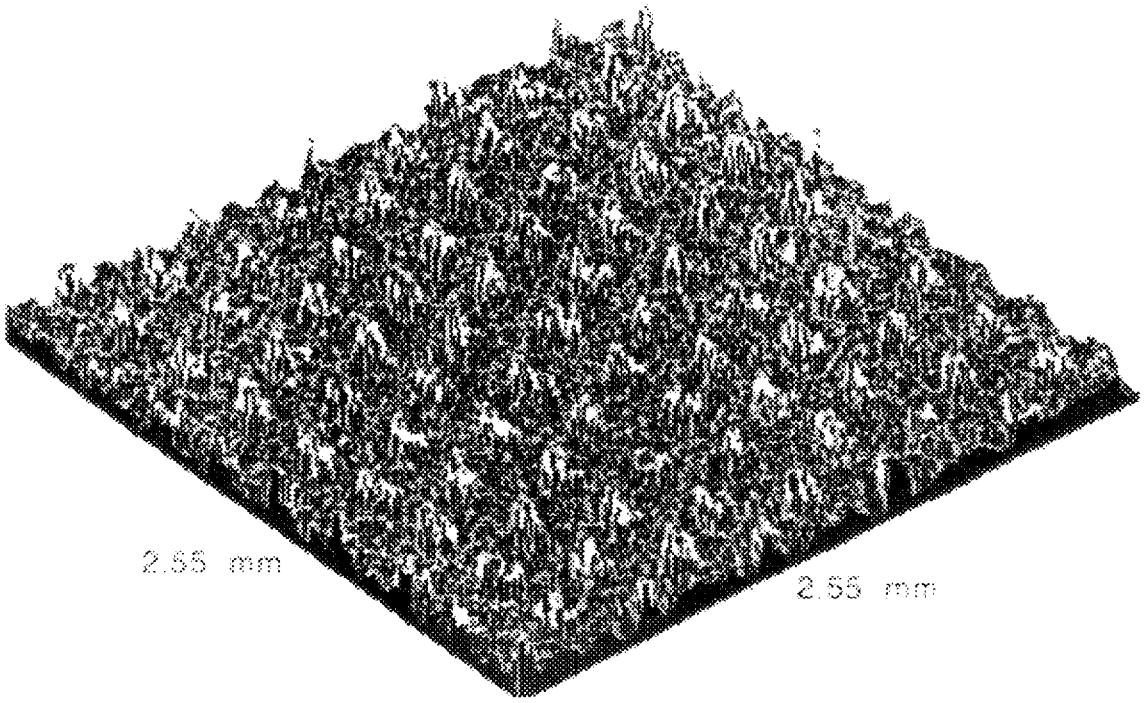

Illustrations of the sheet roughness, after cold reduction rolling with deterministic EBT roughness or after temper rolling with EBT roughness, are given in FIGS. 20 and 21.

However, the presence of high protuberancy or peaks due to material having been extruded in the corresponding crater of the roll can or cannot occur, depending on the thickness reduction of the sheet or strip.

Solution to the wear of the textured work roll during cold reduction rolling

Roll wear during cold reduction rolling is strongly affected by the shape of the rim or the discontinuous peaks on the roll. The ratio of the width to the height of the heaps of the rim on the roll should be at least 3. Otherwise the stresses generated in the heap by the shearing forces are too large and the peak breaks off.

For a round conical rim (with rounded tip), this condition can be realised by using the following parameters:

beam focus point under the roll surface ratio of crater diameter to crater depth larger than 4.

Figure 22:
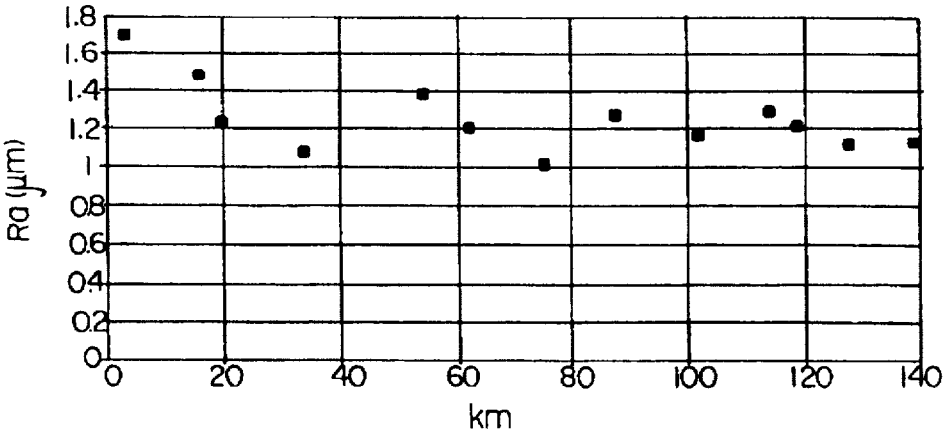
FIG. 22 is a diagram wherein Ra evolution of the EBT textured roll in the tandem mill is represented during a single rolling schedule.

FIG. 22 shows the evolution of Ra during a cold reduction rolling campaign with such a rim shape.

There is a small drop in Ra during the first part of the campaign. After 20 km the roll roughness is stable and there is practically no wear.

A further reduction of the wear has been found by changing the rim shape. It was found that by using a focus point of the beam above the roll surface instead of under the roll surface, the rim shape changes from conical with a rounded tip to a more trapezoidal shape. The ratio of width to height of the trapezium rim should be at least 2 to minimise the wear.

Solution to the problem of pick up of iron fines during reduction rolling

Figure 23:
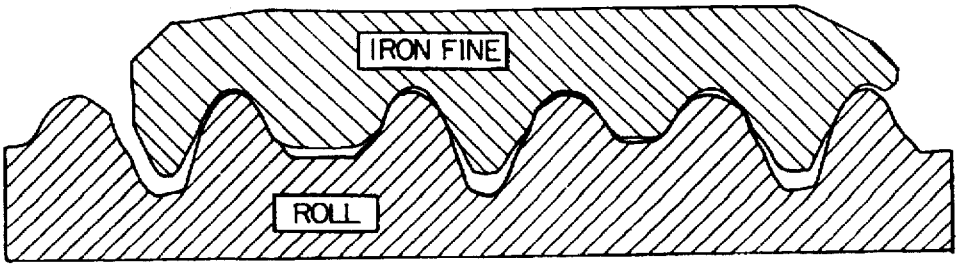
FIG. 23 represents the behaviour of the pick up of iron fine on an EBT textured roll.

Pick up of iron fines on the EBT textured rolls happens when the rim sides are too steep. In that case the iron fine is pressed over the rims and due to elastic spring back after the rolling operation, the iron fine sticks to the roll surface (FIG. 23)

When the sides of the rims are less steep, the friction force between iron fine and roll after elastic spring back of the roll is too small and the iron fine does not stick to the roll.

For a round conical shaped rim, the ratio of width to height should be at least 3 to avoid pick up of iron fine. This condition is realised by following beam parameters:

beam focus point under the roll surface ratio of crater diameter on crater depth larger than 4.

Solution to the problem of sticker marks during batch annealing

During batch annealing the pressure between the windings is distributed over the many fine peaks of the Tandem EBT roughness. The contact pressure on one peak is large and it is very likely that a weld is formed at the top of the peak.

The diameter of the weld at the top of the peak is small (e.g., <40 μm) and only very small forces are necessary to break the weld. This happens during the cooling of the material when the thermal stresses disappear. This elastic relaxation of the windings makes that the welds breaks and that no sticker marks are formed during decoiling of the material.

This mechanism remains true even for very low Ra-values as long as the peaks of the EBT cold reduction roughness are present. No sticker marks were observed for sheets with tandem roughness of 0.5 μm. Once the Ra decreases to 0.5 μm on the sheet, there are practically no peaks any more and sticker marks are not formed.

Solution for the adherence of galvannealed coated steel

A galvannealed layer is formed when Fe and Zn react during an annealing treatment after the hot dip of the sheet in liquid Zn. The surface area plays a very important role in this reaction:

1. the larger the roughness, the larger the specific contact area between Fe and Zn. The reactivity of the reaction increases. It is known that a very rapid reaction can lead to the so-called outburst of FeZn compounds out of the liquid Zn. Such a layer is unhomogeneous which leads to extensive weight loss of the coating during deep-drawing.
2. the larger the waviness, the larger are the thickness differences of the liquid Zn layer before annealing. The waviness can cause important differences: the average Zn thickness can change locally between 5 and 15 μm for an overall average thickness of 10 μm. There are two reasons why the FeZn reaction will start there where the liquid Zn is thinnest:
1. the Al in the liquid Zn forms a layer between the Fe and the liquid Zn before reaction. This layer is an inhibitor for the FeZn reaction and helps to control the reaction. It was found that the Al preferentially deposits in the valleys where the liquid Zn thickness is large.
2. as the thickness of the Zn is larger, it will take more time before the temperature of the Fe Zn interface has reached the value necessary to start the reaction.

These differences in reaction kinetics, due to the waviness of the sheet, also result in an unhomogeneous build up and weight loss during deepdrawing.

Figure 24:
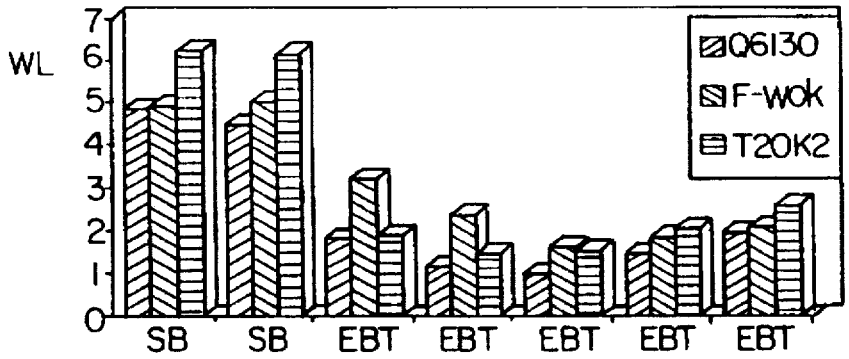
FIG. 24 represents the weight loss (WL) of the coating during drawing of galvanized matter.

By the use of a deterministic cold reduction roughness a homogeneous build up of the Fe Zn compounds is possible. This reduces the weight loss (WL) of the coating during cup drawing to 30% of the value obtained with classical shot blast roughness (see FIG. 24).

The positive effect of the EBT cold reduction roughness comes from 1. smaller specific contact area for a same Ra-value
2. no waviness, so no local differences in reactivity
3. large amount of untouched flat sheet surface between the circular cavities on the steel sheet. Therefore, the ratio of the inner crater diameter versus crater distance on the roll should be smaller than 0.5.

Figure 25:
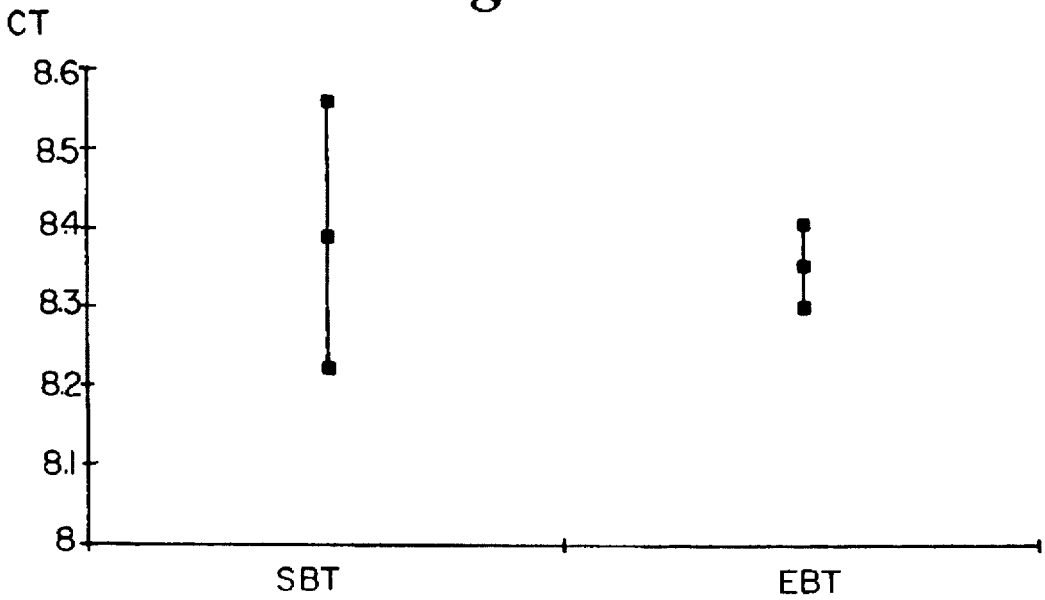
FIG. 25 represents the influence of the cold reduction texture process (SBT and EBT) on the variation of the coating thickness (CT).

The EBT cold reduction roughness reduces also the variation on the coating thickness. In FIG. 25 the mean thickness and variation on the thickness of material with shot blast roughness is compared to material with EBT texture. For a same overall coating weight, the more regular EBT texture reduces the variation to one third of the shot blast value.

Solution to the problem of combining the EBT texture for cold reduction mill with the EBT texture for temper rolling The EBT cold reduction roughness can be combined with EBT textured rolls at the temper mill.

During temper rolling, the homogeneous pattern with the peaks of the same height (5 to 15 μm) is completely ironed out. However, the imprinted more or less circular valleys or indentations of the cold reduction roughness remain in the texture after temper rolling. As described above, during the temper rolling process only imprints of the roll rim are formed, no peaks are produced due to the low contact pressure during temper rolling.

Figure 26:
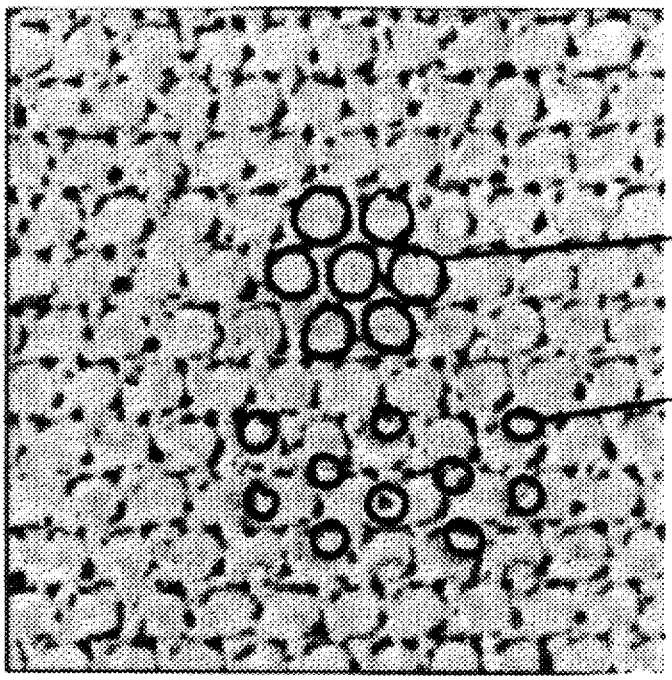
FIGS. 26 & 27 represent the resulting final texture of a metal sheet or strip after having been successively tandem and temper rolled and wherein a controlled mixture of shallow and deep circular valleys appears for coarse roughness (FIG. 26) and fine roughness (FIG. 27).
Figure 27:
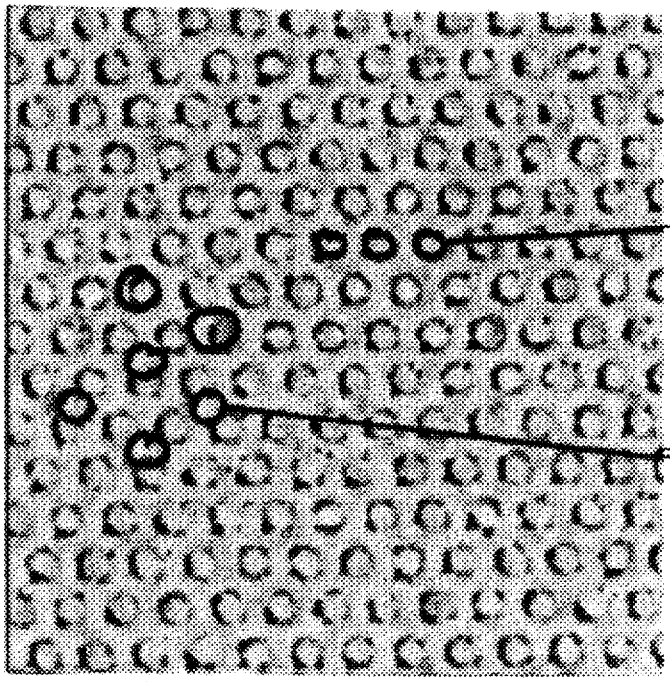

It is easy to make the temper mill valleys deeper. The low shearing forces during temper rolling make it possible to use rolls with high rims without risk to break off during rolling. The resulting texture is composed of a controlled mixture of shallow and deep circular valleys as shown in FIGS. 26 and 27.

Figure 28:
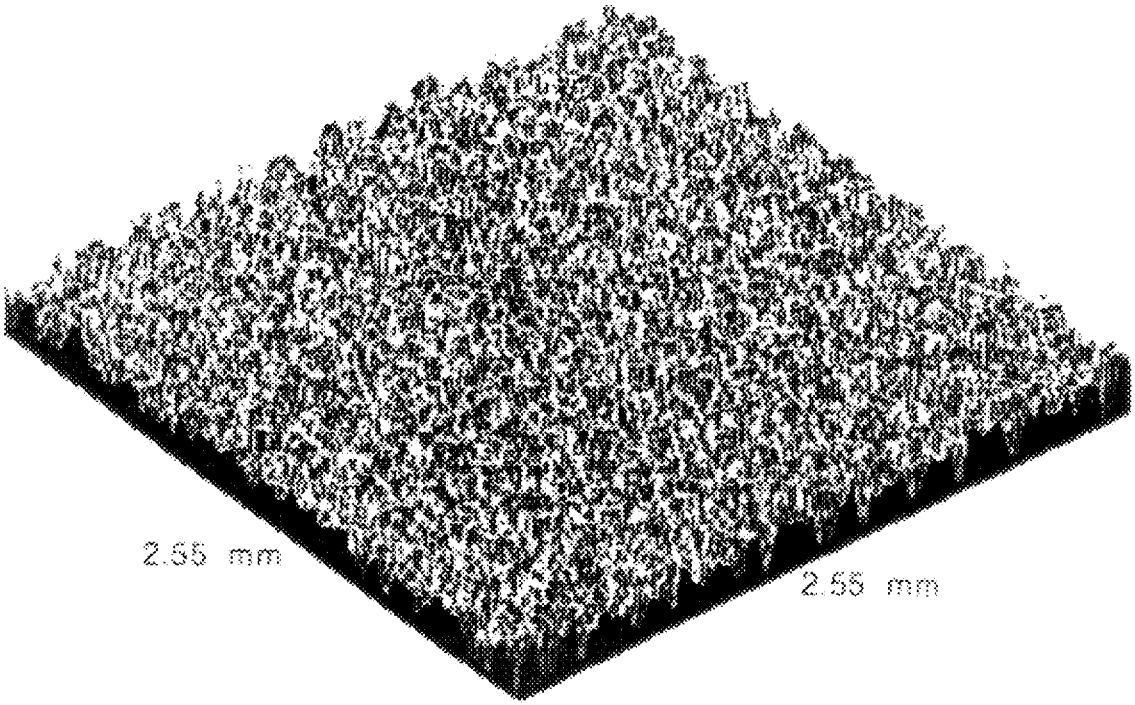
FIGS. 28 & 29 represent two views of three-dimensional texture measurements of a temper rolled strip with a fine (FIG. 28) and a coarse (FIG. 29) deterministic EBT texture.
Figure 29:
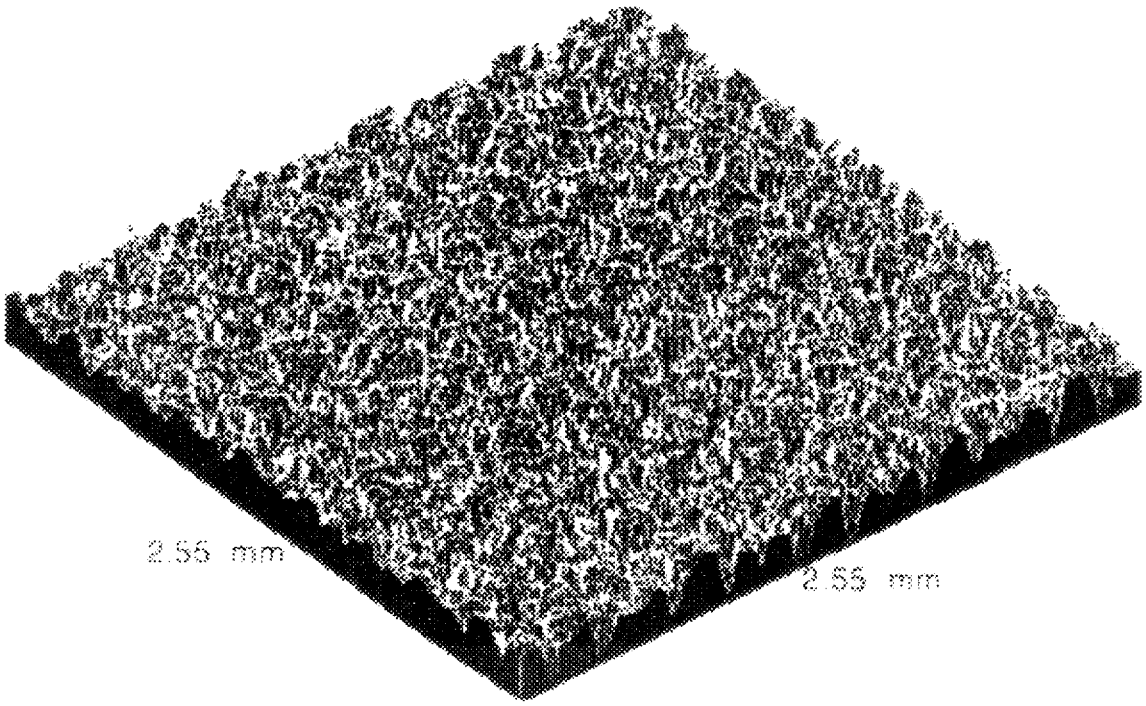

From this phenomenon three unique and unexpected advantages arise:

1. the final mixed sheet texture is absolutely predictable and reproducible. It is the first sheet texture where only fully deterministic rolls are used.
2. the contribution of the cold reduction mill roughness in the final sheet roughness is limited: as the peaks are ironed out and only shallow imprints of the rims remain, the contribution of the cold reduction mill in the final roughness is limited to 0.2 μm Ra. This low contribution facilitates the production of low final roughness values with small variation.
3. the mixture of two populations of valleys (a population of cold reduction mill and a population of the temper mill) results in specific advantages for the deep drawability. The lubrication oil is released gradually, when needed. The shallow valleys readily release the oil content (e.g. at small drawing ratios), whereas the deeper valleys retain the oil much longer, favouring high drawing ratios.
4. no waviness is present in the final texture, even at a high Ra values of i.e 2.5 μm. This is illustrated in the three dimensional texture measurements in FIGS. 28 and 29 of a high and a low temper mill roughness pattern.

Figure 30:
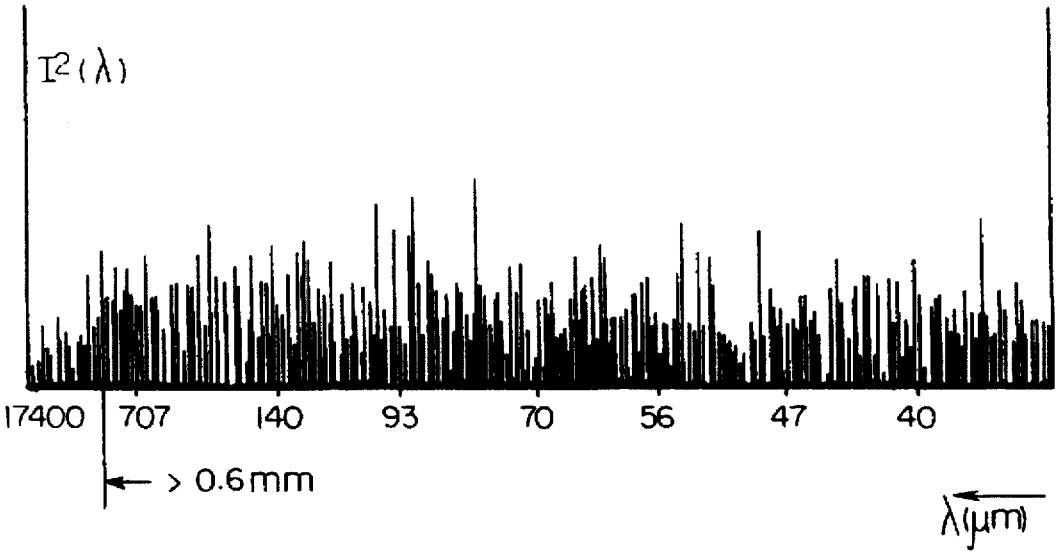
FIGS. 30 & 31 represent the wavelength spectrum for a sheet or strip having been successively tandem and temper rolled in the case of using shot blasting (FIG. 30) and EBT (FIG. 31) textures respectively.
Figure 31:
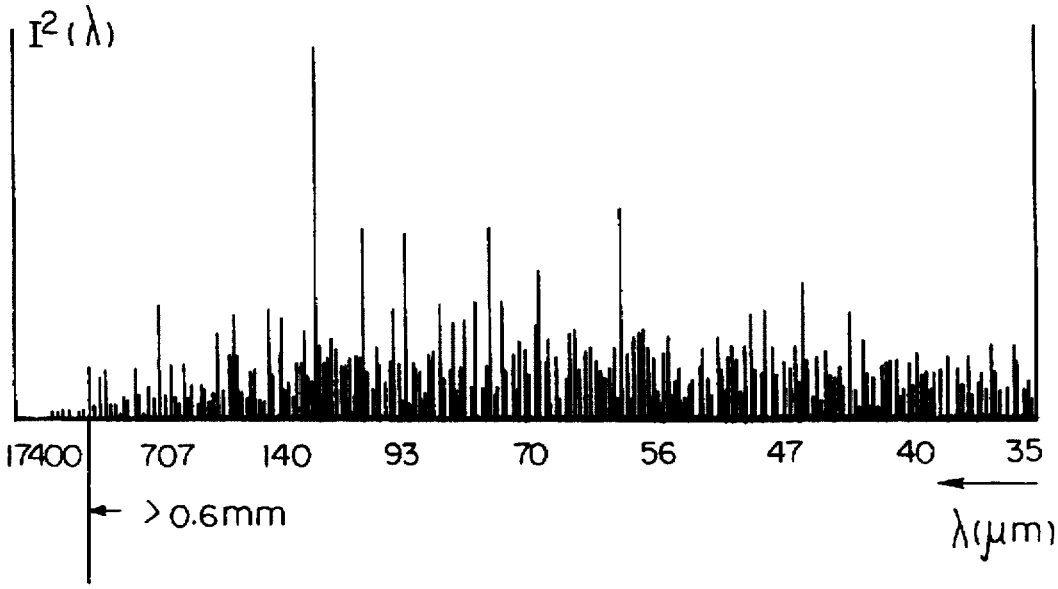

FIGS. 30 and 31 compare the power spectrum of this new sheet texture with a texture where stochastic textured rolls at the cold reduction mill or the temper mill are used. The long wavelengths (>0.6 mm) always appear strongly when stochastic rolls are used and are practically absent for the new sheet texture.

Figure 32:
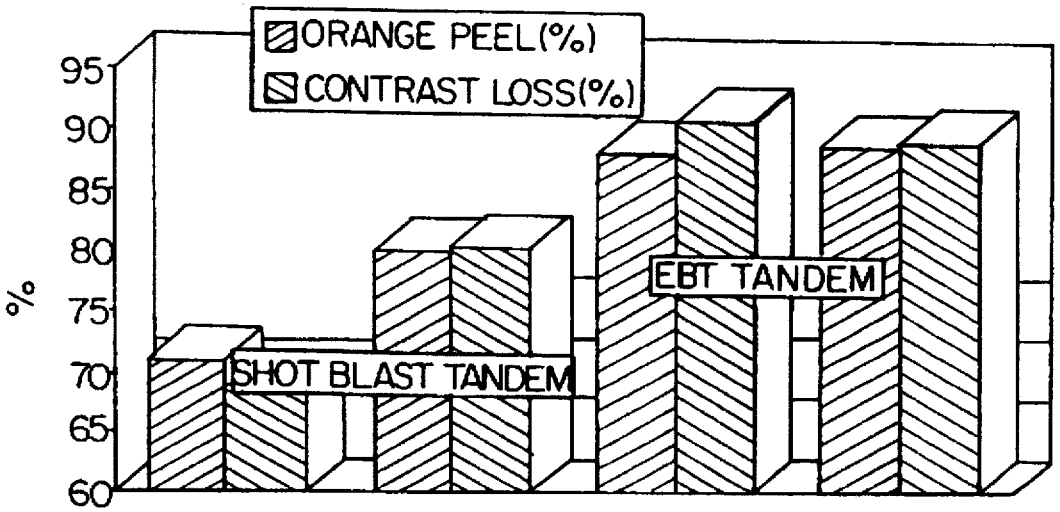
FIG. 32 represents the paint appearance for a sheet where stochastic roughness is used during cold reduction (EBT, LT) and for a sheet where EBT is used.

The absence of long wavelengths results in a significant increase of the paint appearance (see FIG. 32) and, even more important, this increase is independent of the Ra value of the sheet. With the present invention sheet with Ra up to 2.5 μm to favour the drawability and excellent paint appearance can be produced.

We claim:

1. A metal sheet, including a strip, comprising: a surface having a textured surface pattern including a regular bidimensional deterministic pattern of spots, where each spot is an indentation surrounding a protuberance and wherein a waviness of the surface has wavelengths substantially lower than 0.6 mm.

2. A metal sheet according to claim 1, wherein elongation of the sheet under a Euronorm EN 10002-1 test is less than 10%.

3. A metal sheet according to claim 1, wherein the metal sheet has a hardness of at least 80 under the Rockwell B standard.

4. A metal sheet according to claim 1, wherein a roughness of the surface of the metal sheet is in the range of 0.3 to 2.5 μm.

5. A metal sheet according to claim 4, wherein the roughness of the surface of the metal sheet is in the range of 0.5 to 2.0 μm.

6. A metal sheet according to claim 1, wherein a ratio of a width of the indentation to a depth of the indentation on the sheet is at least 2.

7. A metal sheet according to claim 6, wherein the ratio of the width of the indentation to the depth of the indentation on the sheet is at least 3.

8. A metal sheet according to claim 1, wherein a ratio of protuberance diameter to protuberance height is larger than 3.

9. A metal sheet according to claim 8, wherein the ratio of protuberance diameter to protuberance height is larger than 4.

10. A metal sheet according to claim 1, wherein a separation distance between two adjacent protuberances is between 50 and 550 μm and the protuberance has a height in the range of 0 μm to 30 μm.

11. A metal sheet according to claim 10, wherein the separation distance between two adjacent protuberances is between 130 and 320 μm.

12. A metal sheet according to claim 1, wherein the indentation has an inside diameter in a range from 20 μm and 250 μm and has a width in the range of 4–100 μm and has a depth in the range of 0–50 μm.

13. A metal sheet according to claim 12, wherein the inside diameter of the indentation is in a range from 50 μm to 180 μm, the width of the indentation is in a range from 10–75 μm and the depth of the indentation is in a range from 5–30 μm.

14. A metal sheet according to claim 1, wherein the metal sheet has substantially no internal tension at the surface.

15. A metal sheet according to claim 1, wherein a stochastic roughness partially covers the bidimensional deterministic pattern of spots on the surface.

16. A metal sheet according to claim 1, wherein a unideterministic roughness partially covers the bidimensional deterministic pattern of spots on the surface.

17. A metal sheet according to claim 1, wherein the surface is provided with a final mixed texture of two populations of textures, each population of textures having a surface pattern including a bidimensional deterministic pattern of spots.

18. A device for producing metal sheets, including metal strips, comprising a cold reduction roll mill having a pair of work rolls where at least one roll of the pair of work rolls in the cold reduction mill has a texture of surface pattern, the surface pattern including a bidimensional deterministic pattern of spots, where each spot has a crater surrounded by a rim.

19. A device according to claim 18, wherein the cold reduction roll mill is a reversible mill having one stand of work rolls for performing several steps of the rolling operation, the work rolls of the stand of work rolls being changeable a last step of the reduction operation to include the pair of work rolls.

20. A device according to claim 18, wherein the cold reduction roll mill is a tandem mill having several stands so that a reduction operation is performable in one sequence, and the last stand includes the pair of work rolls.

21. A device according to claim 18, further comprising a temper roll mill having a pair of temper rolls wherein at least one roll of the pair of temper rolls of the temper mill has a surface with a textured surface pattern including a regular bidimensional deterministic pattern of spots, where each spot has a crater surrounded by a rim.

22. A device according to claim 21, wherein both rolls of at least one of the pair of work rolls in the cold reduction mill and the pair of temper rolls of the temper mill include a textured surface pattern having a bidimensional deterministic pattern of spots.

23. A method of producing metal sheets, including metal strips, by cold reduction rolling, comprising:

providing a pair of metal work rolls, at least one of the work rolls having a surface textured pattern including a bidimensional deterministic pattern of spots, each spot having a crater surrounded by a rim;

rolling the metal sheet between the pair of work rolls so as to transfer the textured pattern from the at least one of the work rolls to a surface of the metal sheet.

24. A method according to claim 23, further comprising forming the spots on the at least one work tool by an electron beam.

25. A method according to claim 23, wherein a surface roughness on the textured work roll ranges from 0.4–8.0 μm.

26. A method according to claim 25, wherein the surface roughness on the textured work roll ranges from 1.0–3.5 μm.

27. A method according to claim 23, wherein the rim has a width to height ratio of at least 2.

28. A method according to claim 27, wherein a ratio of crater diameter to crater depth is larger than 4.

29. A method according to claim 27, wherein the width to height ratio is at least 3.

30. A method according to claim 23, wherein a distance between adjacent craters ranges from 50 and 550 μm with a crater depth ranges from 5 to 50 μm.

31. A method according to claim 30, wherein the distance between adjacent craters ranges from 130 to 320 μm and the depth ranges from 8 to 30 μm.

32. A method according to claim 23, wherein an inside diameter of the crater is in the range from 20 to 250 μm, the width of the rim is in the range of 4–100 μm and the height of the rim is in the range of 2–50 μm.

33. A method according to claim 32, wherein the inside diameter of the crater is in the range from 50 to 180 μm, the width of the rim is in the range of 10–75 μm and the height of the rim is in the range of 5–35 μm.

34. A method according to claim 23, further comprising temper rolling the metal sheet after cold reduction rolling with a pair of temper rolls, at least one of the pair of temper work rolls being a textured temper roll having a surface pattern provided with a bidimensional deterministic pattern of spots, where each spot has a crater surrounded by a rim, and transferring the surface pattern of the textured temper roll to a surface of the metal sheet.

35. A method according to claim 34, wherein the textured temper work roll has a roughness in the range of 0.4–8.0 μm.

36. A method according to claim 35, wherein the roughness of the textured temper work roll ranges from 1.6–6.0 μm.

37. A method according to claim 23, wherein both rolls of the pair of rolls in at least one of the cold reduction mill and the temper mill include the surface pattern of the bidimensional deterministic pattern of spots.

38. A method according to claim 37, wherein the surface pattern of the textured pair of work rolls in the at least one of the cold reduction mill and the temper mill forms unit cells of spots in a pattern of regular centered hexagons.

39. A method according to claim 23, wherein the metal sheets are formed from a metal selected from the group consisting of steel, stainless steel, aluminum and aluminum alloys.

40. A method according to claim 23, further comprising coating the metal sheets with one of a metallic and an organic layer.

* * * * *